United States Patent [19]

Bonazoli

[11] Patent Number: 4,659,965

[45] Date of Patent: Apr. 21, 1987

[54] HIGH PRESSURE DISCHARGE LAMP WITH THERMAL SWITCH

[75] Inventor: Robert P. Bonazoli, Hamilton, Mass.

[73] Assignee: GTE Products Corporation, Danvers, Mass.

[21] Appl. No.: 552,514

[22] Filed: Nov. 16, 1983

[51] Int. Cl.[4] ..... H01J 7/44

[52] U.S. Cl. ..... 315/60; 313/25; 313/42; 315/73; 315/309

[58] Field of Search ..... 315/308, 309, 60, 74, 315/73; 313/42, 25

[56] References Cited

U.S. PATENT DOCUMENTS

| | | | |
|---|---|---|---|
| 2,235,360 | 3/1941 | Davis | 315/73 |
| 3,307,069 | 2/1967 | Fraser et al. | 315/60 |
| 3,382,403 | 5/1968 | Lloyd | 315/73 |
| 3,858,086 | 12/1974 | Anderson et al. | 315/73 |
| 3,965,387 | 6/1976 | Stuart et al. | 315/360 |
| 4,170,744 | 10/1979 | Hansler | 315/74 |

*Primary Examiner*—Harold Dixon

*Attorney, Agent, or Firm*—José W. Jimenez; Thomas H. Buffton

[57] ABSTRACT

An electric discharge lamp has an arc tube within an outer gas filled glass envelope, and a thermal switching means is located within the outer envelope. The thermal switching means has a bimetal strip and a spring-like member each affixed to at least one of the electrical conductors, and upon application of heat the bimetal strip and spring-like member are flexed to short-circuit the electrical conductors and remove any DC potential between the main electrode and the starting electrode minimizing electrolysis.

6 Claims, 2 Drawing Figures

HIGH PRESSURE DISCHARGE LAMP WITH THERMAL SWITCH

CROSS REFERENCE TO OTHER APPLICATIONS

A co-pending application bearing U.S. Ser. No. 489,623, filed Apr. 28, 1983, bearing the title "Electronic Discharge Lamp With Thermal Switch" and assigned to the Assignee of the present application, relates to a discharge lamp which includes a specific form of thermal switch.

TECHNICAL FIELD

This invention relates to electric discharge lamps and more particularly to electric discharge lamps having a normally open thermal switch therein and to normally open thermal switches having switch distortion inhibiting capabilities.

BACKGROUND ART

Electric discharge lamps such as metal halide lamps which include mercury, the metals of various halides and particularly sodium iodide undesirably are subject to electrolysis between the usual starter electrodes and the electrode immediately adjacent thereto. Moreover, any DC potential existing between the above-mentioned electrodes undesirably increases electrolytic activity and especially so as operational temperatures increase.

Generally, the metal halide lamps include a sealed glass envelope with a fused silica arc tube disposed within the sealed glass envelope. For some time, the outer glass envelope was evacuated whereupon a thermal switch was subjected to a temperature which was determined by lamp wattage and substantially independent of lamp orientation or position of operation. Thus, a simple thermal switch could be incorporated into the outer glass envelope and accommodate temperature variations encountered while employing commercially available bimetal materials.

As an example of the employment of a relatively simple thermal switch in a metal halide discharge lamp, reference is made to U.S. Pat. No. 3,226,597, issued Dec. 28, 1965, in the name of A. C. Green. Therein, a substantially U-shaped bimetal strip expands, in response to heat, to contact an inlead (16) and short-circuit the inleads 16 and 18 respectively.

However, better performance and other desirable features and considerations led to the use of a gas fill within the outer glass envelope. Accordingly, the variable of convective heating was added to lamp wattage in determining the operating temperatures of a thermal or bimetal type switch. Moreover, lighting fixture manufacturers, in recent years, are designing systems to widen the beam spread of available lamps and have utilized the concept of moving the lamp further into the reflector cavity of the fixture. As a result, the temperature of the lamp components and of the thermal switch associated with the lamp has been increased. Unfortunately, sucn increased temperatures tend to stress the bimetallic material of available thermal switches beyond the elastic limit whereupon permanent deformation of the thermal switch undesirably results. Thus, thermal switch failure permits the previously-mentioned electrolysis to take place and results in failure of the discharge lamp.

Additionally, the above-mentioned overheating of the thermal switch presents no problem with regard to deformation when a switch is used which is normally closed and opens as the temperature is increased. However, for normally open switches which close as the temperature increases such permanent discharge of the switch is a problem. Therein, contact closure imposes a restraint in movement of the bimetal material, and this restraint may cause a permanent deformation which prevents return of the switch to a normally open condition and eventually results in lamp failure.

One known attempt to overcome the above-mentioned permanent deformation of the bimetal material in a discharge lamp is set forth in U.S. Pat. No. 3,965,387, issued to Stuart et al on June 22, 1976. Therein, a spring-like member is affixed to one end of a bimetal strip. The bimetal strip is fastened at the opposite end to an electrical conductor of the discharge lamp. Upon activation due to heat, the bimetal flexes which, in turn, causes the spring-like member to contact a second electrical conductor. Thus, short-circuiting of a pair of electrical conductors is effected. Moreover, the spring-like member deflects which prevents distortion of the bimetal strip.

Although the above-described structure has been and still is employed in various forms of discharge lamps, it has been found that this particular structure does leave something to be desired. More specifically, it has been found that individual attachment of a bimetal strip and of a spring-like member permits a precise setting of the gap therebetween which, in turn, enhances control over the operation of the structure. Moreover, this enhanced operational control is achieved without increased cost and with a reduction in complexity of the structure.

OBJECTS AND SUMMARY OF THE INVENTION

An object of the present invention is to provide an improved electric discharge lamp. Another object of the invention is to enhance the response capability to increased temperature variations in an electric discharge lamp. Still another object of the invention is to provide an improved thermal switch applicable for use in an electric discharge lamp. A further object of the invention is to provide a thermal switch of enhanced capability to respond to variations in operational temperatures.

These and other objects, advantages and capabilities are achieved in one aspect of the invention by an electric discharge lamp having an arc tube with an electrode and an adjacent starting electrode sealed therein with the arc tube disposed within a gas filled envelope and a thermal switch external to the arc tube and internal to the envelope. The switch has a bimetal strip and a spring-like member each affixed to one of a pair of electrically conductive members and operative to short-circuit the pair of conductive members.

In another aspect of the invention a thermal switch has a bimetal strip and spring-like member each affixed to an electrical conductor in a manner to short-circuit the pair of electrical conductors upon application of heat thereto in an amount sufficient to reach the closure temperature of the switch. The spring-like member flexes to prevent permanent deformation of the bimetal upon application of an increased temperature.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
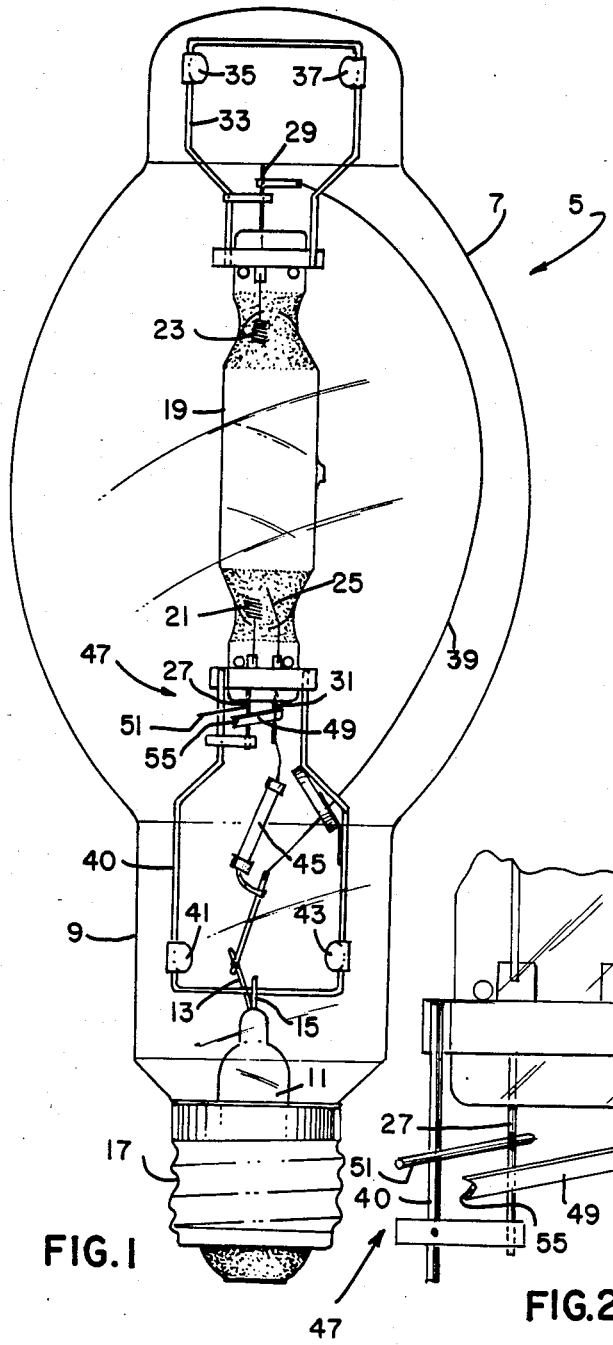
FIG. 1 is an elevational view of a metal halide lamp having one embodiment of a thermal switch of the invention therein.

Referring to FIG. 1 of the drawings, a metal halide lamp 5 includes an outer glass envelope 7 having a bulged substantially tubular configuration with a neck portion 9 closed by a stem member 11 hermetically sealed thereto. A pair of electrically conductive leads 13 and 15 are sealed into and pass through the stem member 11 and are electrically connected to the contacts of a screw-in base member 17.

Disposed within the outer glass envelope 7 is a fused silica arc tube 19. The arc tube 19 has electrodes 21 and 23 sealed into opposite ends thereof, and a starting electrode 25 is sealed into one end of the arc tube 19 and positioned adjacent one of the electrodes 21. The electrodes 21 and 23 and the starting electrode 25 each have an electrical conductive member, 27, 29 and 31 respectively, electrically connected thereto and passing through the sealed are tube 19.

A first cage-like mounting member 33 is affixed to one end of the arc tube 19 and includes a pair of spring-clips 35 and 37 thereon which contact the outer glass envelope 7 and serve to support the arc tube 19 therein. The electrical conductive member 29 connected to the electrode 23 is also connected by a curved wire 39 to one of the electrically conductive leads 13 sealed into the stem member 11 affixed to the outer glass envelope 7.

A second cage-like mounting member 40 is affixed to the opposite end of the arc tube 19 and also includes a pair of spring-clips 41 and 43 thereon which contact the outer glass envelope 7 and serve to more rigidly support the arc tube 19 therein. The second cage-like mounting member 40 is affixed to the other electrically conductive lead 15 sealed into and passing through the stem member 11 affixed to the other electrically conductive lead 15 sealed into and passing through the stem member 11 affixed to the outer glass envelope 7. The electrical conductive member 27 connected to the electrode 21 is also connected to the other electrically conductive lead 15 by way of the second cage-like mounting member 40. Also, the starting electrode 25 is connected by way of an electrical conductive member 31 to a resistor 45 which is, in turn, connected to the electrically conductive lead 13 sealed into the stem member 11.

Figure 2:
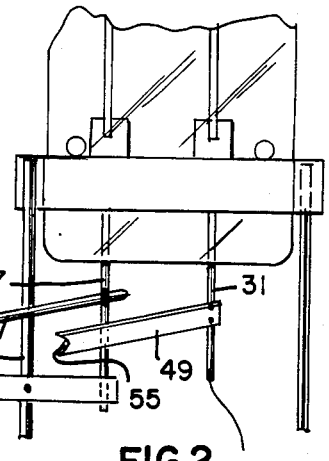
FIG. 2 is an enlarged perspective view of a thermal switch of the invention.

Additionally and importantly, a thermal switching means 47 is spaced from the arc tube 19 and affixed to the electrical conductors 27 and 31. As can be more clearly seen in FIG. 2, a preferred form of switching means 47 includes a bimetal strip 49 affixed to one of the electrical conductors 31 and a spring-like member 51 attached to an adjacent electrical conductor 27. The bimetal strip 49 is affixed at one end 53 to the electrical conductor 31, extends outwardly in a direction substantially normal to the longitudinal axis of the conductor 31 and the arc tube 19 and includes a notch 55 in the opposite end thereof.

Similarly, the spring-like member 51 is fastened at one end 57 to the adjacent electrical conductor 27. This spring-like member 51 extends in a direction substantially normal to the electrical conductor 27 and the arc tube 19 and parallel to the bimetal strip 49. Importantly, the bimetal strip 49 and the spring-like member 51 are spaced from one another and mounted on separate electrical conductors 27 and 31 which permit precise adjustment of the gap therebetween. Also, the notch end 55 of the bimetal strip 49 and the spring-like member 51 are formed for enhanced contact therebetween. Moreover, the spring-like member 51 is positioned to permit deflection thereof in response to pressure exerted thereon by the bimetal strip 49. Thus, distortion of the bimetal strip 47, when exposed to a relatively large increase in heat, is substantially eliminated by the form, location and physical characteristics of the spring-like member 51.

As to operation, the arc tube 19 of a metal halide lamp, for example, normally has a fill which includes mercury and halides of various metals including sodium. Also, the outer glass envelope 7 includes a fill of an inactive gas, such as nitrogen, for example. The thermal switching means 47 is in the form of a normally-open (N/O) switch at room temperature. Moreover, the closure temperature of the thermal switching means 47 is dependent upon numerous factors, such as the placement of the switching means 47 within the envelope 7, the gas fill and the design of the switching means 47. Common thermostats practical for lamp use have been found to be satisfactory to the present application.

Initially current flow to the electrode 21 and starting electrode 25 is effected with the thermal switching means 47 at room temperature. As the temperature increases, the bimetal strip flexes causing the pair of electrical conductors 49 and 51 to short-circuit. Thereupon, any electrolysis inducing DC potential between electrode 21 and starting electrode 25 is eliminated. Also, it can be seen that the notched end portion 55 of the bimetal strip 49 is formed to accommodate the spring-like member 51 whereupon improved electrical connection therebetween is effected. Moreover, the flexible spring-like member 51 readily flexes whenever the bimetal strip 49 flexes. In this manner, distortion of the bimetal strip 49 due to an excessive increase in temperature is prohibited.

Thus, it can readily be seen that the bimetal strip 49 and spring-like member 51 in the form of individual members have numerous advantages over other known structures. Such features as individual adjustment of the gap therebetween and, in turn, the capability to select the location of the thermal switch with respect to the heat developed within the envelope 7 are advantages unavailable in other known structures. Also, the flexing of the spring-like member 51 whereby permanent deformation of the bimetal strip 51 is prevented even when subjected to excessive temperature excursions is still another advantage of the above-described structure.

While there has been shown and described what is at present considered the preferred embodiments of the invention, it will be obvious to those skilled in the art that various changes and modifications may be made therein without departing from the invention as defined by the appended claims.

What is claimed is:

1. An electric discharge lamp having thermal switching means comprising:

an outer glass envelope having a pair of electrically conductive leads sealed therein and passing therethrough;

an arc tube within said outer glass envelope, said arc tube having an electrode within each end electrically coupled to an electrical conductor sealed into and passing therethrough and connected to one of said electrically conductive leads with a starting electrode within one end of said arc tube adjacent one of said electrodes and electrically coupled to an electrical conductor passing through said arc tube and coupled to an electrically conductive lead, said arc tube having a fill of ionizable gas and subject to electrolysis at increased temperatures; and thermal switching means internal of said outer glass envelope and external of said arc tube, said thermal switching means including a bimetal strip and spring-like member spaced from one another in a common plane substantially normal to said adjacent electrical conductors with each affixed to one of said electrical conductors, said bimetal strip and said spring-like member electrically coupled to an electrode and to said adjacent starting electrode with said bimetal strip having a notch formed to receive said spring-like member and short-circuit said electrical conductors upon application of heat to said bimetal strip, to thereby maintain a common potential on both the starting and adjacent electrodes during operation.

2. The discharge lamp of claim 1 wherein said bimetal strip has a notched end formed for contacting said spring-like member upon heating of said discharge lamp.

3. The discharge lamp of claim 1 wherein said spring-like member is formed for movement upon application of pressure thereto by said bimetal strip.

4. The discharge lamp of claim 1 wherein said bimetal strip and said spring-like member are spaced from and parallel to one another prior to heating of said bimetal strip by said discharge lamp.

5. The discharge lamp of claim 1 wherein said arc tube has a gas fill including mercury and halides of various metals including sodium and said thermal switching means has a bimetal strip and spring-like member formed to short-circuit upon heating of said discharge lamp whereby electrolytic activity between adjacent electrodes is inhibited.

6. The discharge lamp of claim 1 wherein said bimetal strip is formed to contact said spring-like member upon heating to a switch closure temperature and to bend said spring-like member upon heating to a temperature greater than said switch closure temperature.

* * * * *